US009284634B2

(12) United States Patent
Hashizume et al.

(10) Patent No.: US 9,284,634 B2
(45) Date of Patent: Mar. 15, 2016

(54) MARTENSITIC STAINLESS STEEL HAVING EXCELLENT CORROSION RESISTANCE

(75) Inventors: Shuji Hashizume, Kawasaki (JP); Yusuke Minami, Kawasaki (JP); Yu Yamamoto, Kawasaki (JP)

(73) Assignee: NKK Tubes, Kawasaki-shi (JP)

( * ) Notice: Subject to any disclaimer, the term of this patent is extended or adjusted under 35 U.S.C. 154(b) by 360 days.

(21) Appl. No.: 14/110,523

(22) PCT Filed: Apr. 11, 2011

(86) PCT No.: PCT/JP2011/059015

§ 371 (c)(1), (2), (4) Date: Oct. 8, 2013

(87) PCT Pub. No.: WO2012/140718

PCT Pub. Date: Oct. 18, 2012

(65) Prior Publication Data

US 2014/0030134 A1 Jan. 30, 2014

(51) Int. Cl.

| | |
|---|---|
| ***C22C 38/42*** | (2006.01) |
| ***C22C 38/00*** | (2006.01) |
| ***C22C 38/02*** | (2006.01) |
| ***C22C 38/04*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |

(52) U.S. Cl.

CPC ..... *C22C 38/42* (2013.01); *C22C 38/001* (2013.01); *C22C 38/02* (2013.01); *C22C 38/04* (2013.01); *C22C 38/44* (2013.01); *C22C 38/46* (2013.01); *C22C 38/48* (2013.01); *C22C 38/50* (2013.01)

(58) Field of Classification Search

None

See application file for complete search history.

(56) References Cited

FOREIGN PATENT DOCUMENTS

| | | | | |
|---|---|---|---|---|
| EP | 1143024 | A1 | | 10/2001 |
| JP | 04-268018 | | | 9/1992 |
| JP | 06-100943 | | | 4/1994 |
| JP | 08-041599 | | * | 2/1996 |
| JP | 08-100235 | | | 4/1996 |
| JP | 08-100236 | | | 4/1996 |
| JP | 2000-178692 | | | 6/2000 |
| JP | 2004-230392 | | | 8/2004 |
| JP | 3620319 | B2 | | 2/2005 |
| JP | 3815227 | B2 | | 8/2006 |
| JP | 2007-314815 | | | 12/2007 |

* cited by examiner

*Primary Examiner* — Deborah Yee

(74) *Attorney, Agent, or Firm* — The Webb Law Firm

(57) ABSTRACT

A purpose of the present invention is to provide a martensitic stainless steel applicable in environments involving both wet carbon dioxide gas and wet hydrogen sulfide and excellent in weldability, manufacturability, and resistance to strain age hardening. Provided is a martensitic stainless steel having excellent corrosion resistance and resistance to strain age hardening comprising, in percent by mass, 0.02% or less of C, 0.02% or less of N, 0.1 to 0.5% of Si, 0.1 to 0.5% of Mn, 10 to 13% Cr, Ni exceeding 5.0% but 8% or less, 1.5 to 3% of Mo, 0.01 to 0.05% of V, 0.16 to 0.30% of Zr, 0.01 to 0.05% of Ta, and the balance of Fe and unavoidable impurities, wherein the martensitic stainless steel satisfies the condition that the sum of the carbon and the nitrogen exceeds 0.02% but 0.04% or less.

2 Claims, No Drawings

MARTENSITIC STAINLESS STEEL HAVING EXCELLENT CORROSION RESISTANCE

CROSS-REFERENCE TO RELATED APPLICATIONS

This application is the United States national phase of International Application No. PCT/JP2011/059015 filed Apr. 11, 2011, the disclosure of which is hereby incorporated in its entirety by reference.

TECHNICAL FIELD

The present invention relates to a martensitic stainless steel with excellent resistance to strain age hardening, suitable for use in line pipes under environments involving wet carbon dioxide gas and wet hydrogen sulfide.

BACKGROUND ART

Steel used in pipelines for oil and natural gas transportation required excellent corrosion resistance according to environments to be used and superior on-site weldability (how high or how low in the preheating temperature and the presence or absence of post-weld heat treatment required for preventing weld joints from cracking, in reference to the cracking susceptibility of welds fabricated on-site in pipeline construction), and grade X52 to grade X65 carbon steel pipes were frequently used.

Work in environments involving wet carbon dioxide gas and wet hydrogen sulfide has increased in recent years, and use of stainless steels is considered from the viewpoint of corrosion resistance, but properties of existing stainless steels are not necessarily sufficient for being used as line pipes and new development of the material is desired.

That is, 0.2C-13Cr stainless steel with good corrosion resistance to environments involving wet carbon dioxide gas and wet hydrogen sulfide is for OCTG (Oil Country Tubular Goods) without need of welding, but requires the high temperature treatment in preheating and post-weld heating to avoid cracking in on-site welding, so that it is not suitable for pipelines in which importance of on-site weldability is emphasized. Duplex stainless steels such as 22Cr or 25Cr do not require preheating or post-weld heat treatment, but is expensive and not suitable for application in pipelines in which a large amount of steel are required.

Patent Documents 1 to 4 then propose 13Cr stainless steels while reducing the amount of C, but it is hard to say that the stainless steels fully satisfy both corrosion resistance in environments involving wet carbon dioxide gas and wet hydrogen sulfide and on-site weldability at a sufficient level simultaneously. To solve the problem Patent Document 5 proposes 13Cr steel with the extremely low amount of Mn of 0.1% or more but below 0.2% in percent by mass and was granted as a patent. This steel is good in on-site weldability and manufacturability as well as in corrosion resistance and resistance to stress corrosion cracking in environments involving both wet carbon dioxide gas and wet hydrogen sulfide, but is insufficient for requirements to resist strain age hardening described below.

On the other hand, in recent years importance of resistance to strain age hardening has been recognized in pipelines for oil wells. In laying the subsea line pipe, the reel barge method is used in which the steel pipe is girth welded for lengthening to improve the efficiency in laying the line pipe, wound in a form of coil to be loaded on the installation vessel as it is, and uncoiled on the vessel to be laid on the sea bottom. In the laying method, the weld joint is subjected to large deformation and thereafter contacted to the transport fluid at high temperature, for example, approximately 150° C. for a long period, potentially deteriorating toughness through strain age hardening at the vicinity of the weld. It is known that since resistance to strain age hardening is affected by the solid solution of C and N, Ti which can fix these elements is most effective (Patent Document 6). However, formation of fine TiC precipitates when fixing C with Ti results in an increase of the strength (hardness) and potentially causing embrittlement.

PATENT DOCUMENTS

Patent Document 1: Japanese Patent Application Laid-Open (JP-A) No. 6-100943.

Patent Document 2: Japanese Patent Application Laid-Open (JP-A) No. 4-268018.

Patent Document 3: Japanese Patent Application Laid-Open (JP-A) No. 8-100235.

Patent Document 4: Japanese Patent Application Laid-Open (JP-A) No. 8-100236.

Patent Document 5: Japanese Patent Publication No. 3620319.

Patent Document 6: Japanese Patent Publication No. 3815227.

DISCLOSURE OF INVENTION

Problems to be Solved by the Invention

The purpose of the present invention is, in view of the fact that materials have been unavailable which have good resistance to strain age hardening in addition to excellent corrosion resistance in environments involving both wet carbon dioxide gas and wet hydrogen sulfide and on-site weldability, to provide a material satisfying these characteristics. Particularly, while in the past consideration on strain age hardening was insufficient, thereby making the selection of the laying method of submarine pipe very limited, the present invention allows use of the laying method of line pipe based on the economic reel-lay method.

SUMMARY OF INVENTION

Means for Solving Problems

The present inventors investigated various compositions of martensitic stainless steels for achieving the above purpose and obtained the following findings. The present inventors found that (1) Cr is effective for improving corrosion resistance to acids in wet carbon dioxide gas, (2) while resistance to sulfide stress corrosion cracking becomes an issue in environments involving wet hydrogen sulfide, reduction of hydrogen permeation into steel is important to improve corrosion resistance to wet hydrogen sulfide, and it is effective to add more than certain amounts of Mo as well as Cr and to reduce the amounts of Mn, the element as a desulfurization agent and Si, the element as the deoxidation agent, (3) control of the amounts of C and N is effective for improving weldability and manufacturability, and further (4) the combined addition of V, Zr, and Ta is essential for obtaining resistance to strain age hardening when loaded with strain. That is, the present invention relates to martensitic stainless steels with good corrosion resistance to both wet carbon dioxide gas and wet hydrogen sulfide, good weldability, good manufacturability, and good resistance to strain age hardening and it has the following constitution. Manufacturability herein means that the mechanical properties are consistent against variation of manufacturing conditions such as heat treatment.

The present invention uses the following means in order to obtain martensitic stainless steels with the above performance.

(1) The martensitic stainless steel having excellent corrosion resistance and resistance to strain age hardening comprising, in percent by mass, 0.02% or less of C, 0.02% or less of N, 0.1 to 0.5% of Si, 0.1 to 0.5% of Mn, 10 to 13% of Cr, Ni exceeding 5.0% but 8% or less, 1.5 to 3% of Mo, 0.01 to 0.05% of V, 0.16 to 0.30% of Zr, 0.01 to 0.05% of Ta, and the balance of Fe and unavoidable impurities, wherein the sum of the carbon and the nitrogen exceeds 0.02% but 0.04% or less.

(2) The martensitic stainless steel having excellent corrosion resistance and resistance to strain age hardening comprising, in percent by mass, 0.02% or less of C, 0.02% or less of N, 0.1 to 0.5% of Si, 0.1 to 0.5% of Mn, 10 to 13% of Cr, Ni exceeding 5.0% but 8% or less, 1.5 to 3% of Mo, 0.01 to 0.05% of V, 0.16 to 0.30% of Zr, 0.01 to 0.05% of Ta, and further one type or two types or more of 0.1 to 3% of W, 0.1 to 3% of Cu, and 0.01 to 0.1% of Nb, and the balance of Fe and unavoidable impurities, wherein the sum of the carbon and the nitrogen exceeds 0.02% but 0.04% or less.

Effects of the Invention

According to the present invention, optimization of the alloy composition in 13% Cr martensitic stainless steel allows for yielding a martensitic stainless steel having excellent corrosion resistance in environments involving wet carbon dioxide gas and wet hydrogen sulfide and good weldability and resistance to strain age hardening. The steel can not only be used as the line pipe material for oil and natural gas, but also it can increase the installation efficiency of pipeline, thereby producing significant effects on the industry.

DESCRIPTION OF EMBODIMENTS

Best Modes for Carrying Out the Invention

The reason to add the alloy elements in the present invention and the reason to specify the content thereof will be described below. The content of each alloy element in the steel is based on the percent by mass.

C: 0.02% or Less

Carbon is the element to form carbides with Cr in the steel increasing the strength, but when added in excess, the amount of Cr available for effectively improving corrosion resistance is reduced. Also, hardness of the steel at the heat affected zone of weld is increased thereby requiring the post-weld heat treatment, so that the upper limit of C is set at 0.02%.

N: 0.02% or Less

While N forms compounds with Cr in the steel to reduce the amount of Cr available for effectively improving corrosion resistance and therefore is a harmful element in terms of improving corrosion resistance, it is also an austenite forming element to prevent the formation of δ-ferrite phase. When the content of N exceeds 0.02%, it not only makes hardness of the heat affected zone of weld higher, but also is precipitated as nitrides during tempering to deteriorate corrosion resistance, stress corrosion cracking resistance, and toughness as well as to promote strain age hardening so that the upper limit of N is set at 0.02%.

Si: 0.1 to 0.5%

Si is added as the deoxidizer, but the content of 0.1% or less does not produce the deoxidation effects. When Si is added in excess, δ-ferrite phase is formed to lower corrosion resistance and therefore, the upper limit of Si is set at 0.5% so that the amount of Ni does not increase to ensure the phase balance.

Mn: 0.1 to 0.5%

Mn is added as the desulfurization agent in steelmaking, and when the content is below 0.1%, its effects are not observed and the hot workability is reduced. When added in excess, corrosion resistance in environments involving carbon dioxide gas and hydrogen sulfide is reduced. Therefore, the upper limit of Mn is set at 0.5%.

Cr: 10 to 13%

Cr is the element effective for improving corrosion resistance in environments involving wet carbon dioxide gas, but when the content is below 10%, its effects cannot be observed. While increase of the Cr content improves corrosion resistance, increase of the content of Ni, expensive austenite forming element, is required for forming the martensite phase since it is a strong ferrite forming element. Therefore, the upper limit of Cr is set at 13%. Preferably, the content of Cr is from 12.0 to 12.8%, more preferably from 12.2 to 12.6%.

Ni: Exceeding 5.0% but 8% or Less

Ni is an element required for forming the martensite phase, but when the content of Ni is 5.0% or less, more δ-ferrite phase is formed to impair toughness and corrosion resistance, whereas when the content exceeds 8%, economy worsens because it is expensive. Therefore, a range of the content is set to exceed 5.0% but 8% or less. Preferably the content of Ni is from 5.4 to 7.0%, more preferably from 5.8 to 6.6%.

Mo: 1.5 to 3%

Mo is an element effective for improving corrosion resistance, but when the content is below 1.5%, its effects are insufficient. Since Mo is the ferrite forming element, when it is added at the content exceeding 3%, the amount of expensive Ni added has to be increased to ensure the phase balance. Therefore, a range of the content of Mo is from 1.5 to 3%. Preferably the content of Mo is from 1.5 to 2.5%.

V: 0.01 to 0.05%

V is a strong carbonitride forming element to uniformly precipitate fine particles of carbides and nitrides in grains, to prevent preferential precipitation at grain boundaries, thereby making crystal grains very fine to improve resistance to stress corrosion cracking as well as to contribute to improvement of the strength. Additionally, since V fixes carbon and nitrogen, V is also effective for improving resistance to strain age hardening. However, V is a ferrite forming element to increase δ-ferrite phase. When the content of V is below 0.01%, its effects for improving stress corrosion cracking resistance cannot be observed, whereas when the content exceeds 0.05%, its effects level off to saturation and δ-ferrite phase is increased. Therefore, the content of V is set at 0.01 to 0.05%.

Zr: 0.16 to 0.30%

Since Zr is a strong carbonitride forming element to precipitate fine carbides and nitrides whereby fixing carbon and nitrogen, it is also effective for improving the strength and resistance to strain age hardening. Additionally, Zr prevents hardening of the austenite partially contained when loaded with strain. When the content of Zr is below 0.16%, its effects are insufficient, whereas when exceeding 0.30%, its effects level off to saturation. Therefore, the content of Zr is set at 0.16 to 0.30%.

Ta: 0.01 to 0.05%

Since Ta is a strong carbides and nitrides forming element to fix carbon and nitrogen and uniformly precipitate fine carbides and nitrides in grains, it is effective for improving resistance to strain age hardening. Additionally, Ta prevents hardening of the austenite partially contained when loaded with strain. Also, its effects become larger when Zr coexists. When the content of Ta is below 0.01%, its effects are insufficient, whereas when exceeding 0.05%, the strength is increased excessively. Therefore, the content of Ta is set at 0.01 to 0.05%.

Carbon Plus Nitrogen: Exceeding 0.02% but 0.04% or Less

While each element of C and N is added within a range of the amount specified above, a sum of C and N will be further defined in the present invention. The sum of C and N is set to exceed 0.02% for yielding the yield strength of 600 to 700 MPa as the target strength and the sum of C and N is set at 0.04% or less for controlling the hardness of the heat affected zone of weld to be 350 Hv or less as the target hardness.

W and Cu: 0.1 to 3%

Both elements are effective for increasing the strength and improving corrosion resistance, and when added, their effects are insufficient with the content below 0.1%, whereas when exceeding 3%, the hot workability is deteriorated. Therefore, the contents of W and Cu are set at 0.1 to 3%, respectively.

Nb: 0.01 to 0.1%

While Nb is the element to form carbides with carbon in the steel and to improve the strength and toughness by making finer crystal grains, when added its effects are insufficient in the content below 0.01%, whereas when exceeding 0.1%, their effects level off to saturation. Therefore, the content of Nb is set at 0.01 to 0.1%.

The steel of the present invention may be melted by any one of the melting methods such as the converter process, the electric furnace process, and the blending process thereof so far as the alloy component can be adjusted to the desired component range specified above. After melting, it is converted to slabs or billets through the continuous casting machine or the casting mold, followed by hot rolling to fabricate into a desired shape such as steel pipe, steel sheets or the like and then by heat treatment for desired strength. Heat treatment is preferably performed to adjust the strength by tempering after cooling after fabrication or conversion to the martensite transformation structure by normalization.

EXAMPLES

Steels with the chemical composition indicated in Table 1 were melted using a vacuum melting furnace, which were then hot-rolled to a steel sheet with thickness of 12 mm, followed by quenching and tempering to obtain the yield strength of 600 to 700 MPa as the target. Provided mill operation, the steel sheet at heating temperature of 920±10° C. was water-cooled and then tempered at 640±10° C.

After heat treatment, corrosion resistance and weldability were investigated.

A test for evaluating corrosion resistance to wet carbon dioxide gas was performed by using a 20% NaCl-30 atm $CO_2$ solution for 336 hours at 100° C., taking into account practical environments of steel tubes exposed, and it was concluded to pass the test when the corrosion rate was 0.3 mm/year or less.

The four point bend beam test was performed for evaluating corrosion resistance to sulfide stress cracking (SSC resistance test) in wet hydrogen sulfide. The test condition was to load 100% of the proof stress in a 0.1% NaCl aqueous solution containing 0.4 g/L of $CH_3COONa$ (pH=3.6) saturated with $H_2S$ at 0.01 bar taking into account practical environments of steel tubes exposed, and it was concluded to pass the test when no failure was observed after 720 hours.

In weldability test the specimen with the HAZ reproduced was prepared for assessing whether or not preheating and/or post heating is required in on-site welding and it was concluded to pass the test when the hardness was 350 Hv or less. In the test on resistance to strain age hardening it was concluded to pass the test when increase of hardness was 30 Hv or less after loaded with strain at 6%.

Table 2 shows the test results. The specimens of S1 to S7, steels of the present invention, show good results in strength, corrosion resistance, sulfide stress cracking resistance (SSC resistance: corrosion resistance to wet hydrogen sulfide), weldability, and resistance to strain age hardening. On the other hand, Comparative Steel C1 contains the amounts of Zr within a range specified in the present invention but less amount of Ta, resulting in insufficient resistance to strain age hardening. Comparative Steel C2 is presumed to increase the formation of free carbon because of less amount of Zr increasing the strength, resulting in poor resistance to sulfide stress cracking. Comparative Steel C3 contains small amounts of Mo and shows insufficient corrosion resistance. Comparative Steel C4 contains a high level of N and a sum of carbon and nitrogen and failed the weldability test. Also neither one of Comparative Steels C5 or C6 contains Ta and Zr, and their strength does not meet the specified value and resistance to strain age hardening is also insufficient.

TABLE 1

Chemical composition (mass percent) of steels for testing

| | C | Si | Mn | P | S | N | Ni | Cr | Mo | V | Ta | Zr | W | Cu | Nb | C + N | Reference |
|---|---|---|---|---|---|---|---|---|---|---|---|---|---|---|---|---|---|
| S1 | 0.011 | 0.20 | 0.22 | 0.010 | 0.001 | 0.0144 | 6.11 | 12.57 | 2.28 | 0.034 | 0.015 | 0.235 | 0.00 | 0.00 | 0.00 | 0.0254 | Invented steel |
| S2 | 0.012 | 0.21 | 0.22 | 0.010 | 0.001 | 0.0129 | 6.11 | 12.55 | 2.23 | 0.034 | 0.023 | 0.180 | 0.00 | 0.00 | 0.00 | 0.0249 | Invented steel |
| S3 | 0.012 | 0.21 | 0.22 | 0.010 | 0.001 | 0.0132 | 6.11 | 12.52 | 2.24 | 0.034 | 0.024 | 0.282 | 0.00 | 0.00 | 0.00 | 0.0252 | Invented steel |
| S4 | 0.012 | 0.19 | 0.22 | 0.011 | 0.001 | 0.0115 | 6.09 | 12.45 | 2.21 | 0.033 | 0.034 | 0.160 | 0.00 | 0.00 | 0.00 | 0.0235 | Invented steel |
| S5 | 0.012 | 0.48 | 0.28 | 0.010 | 0.001 | 0.0138 | 6.50 | 12.55 | 1.54 | 0.033 | 0.013 | 0.176 | 1.98 | 0.00 | 0.00 | 0.0258 | Invented steel |
| S6 | 0.012 | 0.21 | 0.45 | 0.010 | 0.001 | 0.0144 | 6.21 | 12.43 | 2.15 | 0.034 | 0.024 | 0.210 | 0.00 | 1.88 | 0.00 | 0.0264 | Invented steel |
| S7 | 0.014 | 0.20 | 0.31 | 0.010 | 0.001 | 0.0125 | 5.98 | 12.22 | 2.08 | 0.034 | 0.022 | 0.182 | 0.00 | 0.00 | 0.03 | 0.0264 | Invented steel |
| C1 | 0.011 | 0.20 | 0.22 | 0.011 | 0.001 | 0.0160 | 6.20 | 12.50 | 2.27 | 0.034 | 0.001 | 0.165 | 0.00 | 0.00 | 0.00 | 0.0270 | Comparative steel |
| C2 | 0.013 | 0.19 | 0.50 | 0.010 | 0.001 | 0.0116 | 6.24 | 12.56 | 2.34 | 0.033 | 0.040 | 0.092 | 0.00 | 0.00 | 0.00 | 0.0246 | Comparative steel |
| C3 | 0.012 | 0.21 | 0.22 | 0.010 | 0.001 | 0.0134 | 5.43 | 12.11 | 1.23 | 0.033 | 0.023 | 0.144 | 0.00 | 0.00 | 0.00 | 0.0254 | Comparative steel |
| C4 | 0.017 | 0.20 | 0.41 | 0.010 | 0.001 | 0.0251 | 6.21 | 12.34 | 2.33 | 0.034 | 0.023 | 0.156 | 0.00 | 0.00 | 0.00 | 0.0421 | Comparative steel |
| C5 | 0.013 | 0.22 | 0.27 | 0.010 | 0.001 | 0.0121 | 7.31 | 12.59 | 2.32 | 0.033 | 0.000 | 0.000 | 0.00 | 0.00 | 0.00 | 0.0251 | Comparative steel |
| C6 | 0.011 | 0.28 | 0.15 | 0.010 | 0.001 | 0.0162 | 5.42 | 10.83 | 2.71 | 0.033 | 0.000 | 0.000 | 0.00 | 0.00 | 0.00 | 0.0272 | Comparative steel |

Note:
The values enclosed in rectangle indicate that the chemical composition is not in the range of steels in the present invention.

TABLE 2

Table 2 Summary of test results

| No. | 0.2% offset yield strength (MPa) | Corrosion resistance (corrosion rate) | SSC test (four point bend beam test) | Weldability test | Test for resistance to strain age hardening | Overall assessment | Reference |
|---|---|---|---|---|---|---|---|
| S1 | 671 | 0 02 | No failure | 338 | 25 | Good | Invented steel |
| S2 | 670 | 0.02 | No failure | 333 | 28 | Good | Invented steel |
| S3 | 649 | 0.02 | No failure | 335 | 24 | Good | Invented steel |
| S4 | 697 | 0.02 | No failure | 327 | 27 | Good | Invented steel |
| S5 | 655 | 0.02 | No failure | 339 | 27 | Good | Invented steel |
| S6 | 672 | 0.02 | No failure | 329 | 28 | Good | Invented steel |
| S7 | 698 | 0.02 | No failure | 333 | 29 | Good | Invented steel |
| C1 | 635 | 0.02 | No failure | 338 | 31 | No Good | Comparative steel |
| C2 | 716 | 0.02 | Failure | 335 | 21 | No Good | Comparative steel |
| C3 | 677 | 0.31 | No failure | 310 | 28 | No Good | Comparative steel |
| C4 | 683 | 0 02 | No failure | 355 | 27 | No Good | Comparative steel |
| C5 | 557 | 0.02 | No failure | 336 | 34 | No good | Comparative steel |
| C6 | 587 | 0.01 | No failure | 340 | 33 | No good | Comparative steel |

INDUSTRIAL APPLICABILITY

The martensitic stainless steel of the present invention has excellent corrosion resistance in environments involving wet carbon dioxide gas and wet hydrogen sulfide, good weldability, and good resistance to strain age hardening, and is applicable as the line pipe for oil and natural gas, so that it is obvious that the steel has significant effects on the industry.

The invention claimed is:

1. A martensitic stainless steel having excellent corrosion resistance and resistance to strain age hardening comprising, in percent by mass, 0.02% or less of C, 0.02% or less of N, 0.1 to 0.5% of Si, 0.1 to 0.5% of Mn, 10 to 13% of Cr, Ni exceeding 5.0% but 8% or less, 1.5 to 3% of Mo, 0.01 to 0.05% of V, 0.16 to 0.30% of Zr, 0.01 to 0.05% of Ta, and the balance of Fe and unavoidable impurities, wherein the martensitic stainless steel satisfies the condition that the sum of the carbon and the nitrogen exceeds 0.02% but 0.04% or less.

2. A martensitic stainless steel having excellent corrosion resistance and resistance to strain age hardening comprising, in percent by mass, 0.02% or less of C, 0.02% or less of N, 0.1 to 0.5% of Si, 0.1 to 0.5% of Mn, 10 to 13% of Cr, Ni exceeding 5.0% but 8% or less, 1.5 to 3% of Mo, 0.01 to 0.05% of V, 0.16 to 0.30% of Zr, 0.01 to 0.05% of Ta, and further one type or two types or more of 0.1 to 3% of W, 0.1 to 3% of Cu, and 0.01 to 0.1% of Nb, and the balance of Fe and unavoidable impurities, wherein the martensitic stainless steel satisfies the condition that the sum of the carbon and the nitrogen exceeds 0.02% but 0.04% or less.

* * * * *